US005249545A

United States Patent [19]

Gettman

[11] Patent Number: 5,249,545

[45] Date of Patent: Oct. 5, 1993

[54] PERSONAL WATERCRAFT CRADLE AND METHOD OF USE

[76] Inventor: Jon V. Gettman, R.R. 2-S96, Fremont, Nebr. 68025

[21] Appl. No.: 897,491

[22] Filed: Jun. 12, 1992

[51] Int. Cl.[5] ..... B63D 35/40

[52] U.S. Cl. ..... 114/259; 280/414.1

[58] Field of Search ..... 114/343, 259, 263, 344; 280/414.1, 414.2

[56] References Cited

U.S. PATENT DOCUMENTS

| | | | |
|---|---|---|---|
| 3,130,842 | 4/1964 | Melloni | 280/414.1 X |
| 3,831,790 | 8/1974 | Farris | 280/414.1 X |
| 3,889,973 | 6/1975 | Fehseke | 280/414.1 X |
| 3,993,324 | 11/1976 | Carrick | 280/414.1 |
| 4,664,401 | 5/1987 | Carrick | 280/414.1 |

*Primary Examiner*—Sherman Basinger
*Attorney, Agent, or Firm*—James D. Welch

[57] ABSTRACT

A lightweight cradle system for use in launching, beaching, transporting and storing personal watercraft, such as Jet-Skis is disclosed. The cradle system cradles a personal watercraft with side and front support pads, and with roller systems at the lower aspect thereof. During use water is allowed to enter hollow side pipes and provide stabilizing effective weight to the cradle system. Use of the present invention allows an unaided young or small physical stature person to safely secure a launched personal watercraft without causing damage thereto. The present invention also provides elements which allow grasping and carrying of a cradle system/personal watercraft combination by two or more physically capable persons.

18 Claims, 1 Drawing Sheet

PERSONAL WATERCRAFT CRADLE AND METHOD OF USE

TECHNICAL FIELD

The present invention is related to personal watercraft. More particularly the present invention is related to a light weight, easy to use cradle system for facilitating the launching, beaching, transporting and storing of personal watercraft, such as Jet-Skis, and the method of its use.

BACKGROUND

Recreational and competitive use of personal watercrafts has become widespread in recent years. An example of a personal watercraft is a Jet-Ski. In general, a Jet-Ski is a motorized vehicle for use in water, which is typically operated by one person, and which commonly provides means for carrying one or more passengers. A rough, land based, analogy of a Jet-Ski is a motorcycle, and a Jet-Ski is operated in water in a manner roughly analogous to how a motorcycle is operated on land. However, a Jet-Ski has no wheels present on its lower aspects, but rather a hull, roughly similar to a boat hull, is present.

While a Jet-Ski is relatively easy to maneuver when boyant in water, it is to be understood that a typical Jet-Ski weighs on the order of hundreds of pounds. In that, as mentioned, wheels typically are not a part of a Jet-Ski, it should be apparent that a problem exists in that younger users, small physical stature adults or even stronger unaided individual users, can have a problem maneuvering a Jet-Ski when it is not boyant in water. The problem manifests itself during launching, beaching and dry land transporting or storing of jet-Skis. A particularly critical example of the problem manifests when an individual wishes to secure a Jet-Ski which is in a body of water, and no one is present to help. A typical practice in such a situation is to simply run the Jet-Ski onto a beach at the edge of the body of water in which the Jet-Ski is used. This, however, can cause damage to the Jet-Ski underside by abrasion, or for instance when the Jet-Ski is run onto a rock.

A search for Patents has revealed that inventors have recognized the identified problem(s) and proposed systems to overcome at least some aspects thereof. A Patent to Taylor, U.S. Pat. No. 5,005,846 describes a transport carriage system for use in transporting Jet-Skis, particularly in the beds of pickup trucks. Longitudinally directed members having lengths less than that of the bed of a pickup truck, and which are laterally separated by a distance less than half the width of the bed of a pickup truck are provided and support a Jet-Ski thereon. Another Patent, U.S. Pat. No. 4,960,356 to Wren describes a system for loading, unloading and storing a jet propelled water vehicle of the type having a pair of parallel grooves in its hull. A first pair of horizontal parallel hollow tubes, situated so as to be capable of providing support to a jet propelled water vehicle at locations of parallel grooves in its hull are present, as are a second pair of hollow tubes which slideably mount into the first pair of horizontal parallel hollow tubes. In use the second pair of hollow tubes can be extended from the first pair of horizontal parallel hollow tubes which are secured to, for instance, the bed of a pickup truck, and be caused to bend downward so as to place their leading ends at locations under the surface of a body of water, near an edge thereof. A jet propelled water vehicle can then be run along the combination of hollow tubes from, or into the water. Another Patent, U.S. Pat. No. 5,016,893 to Hart Jr. describes another system titled a "Collapsible Support and Transport Stand for Personal Watercraft". This invention provides a cradle which can be adjusted as regards the lateral width thereof and as regards the vertical height of the upper aspect thereof. In addition skids are present on the lower aspects thereof, in which skids are present spring biased retractable wheels. In use a personal watercraft can be slid onto the upper aspect of the cradle, which cradle has been properly adjusted to receive the personal watercraft and properly support it, perhaps from the bed of a pickup truck. The invention can then be pushed to the location of the edge of a body of water optimally utilizing the skids and/or the wheels therein to travel over the terrain present, the vertical height of the upper aspect of the cradle adjusted down, and the personal watercraft pushed off thereof and into the water. A reverse procedure will remove a personal watercraft from a body of water and the system of the invention will mediate its placement into, for instance, the bed of a pickup truck. In addition, Patents which describe systems for transporting and/or launching boats are known and include U.S. Pat. No. 3,879,060 to Slack et al.; U.S. Pat. No. 2,462,964 to Heggen; U.S. Pat. No. 5,066,033 to Kolstad et al. and U.S. Pat. No. 4,911,459 to Smyly Sr.

A study of known Patents indicates that while inventors have provided specific systems which solve some aspects of the problems associated with the transporting and storing of personal watercrafts, there is need for additional systems, and methods of their use.

DISCLOSURE OF THE INVENTION

The present invention comprises a cradle system, and method of its use, which cradle system can cradle a personal watercraft, such as a Jet-Ski, and facilitate launching, beaching, transport and storage thereof.

The present invention is of relatively simple construction, yet allows one young or small physical stature person to, for instance, easily secure a personal watercraft at the edge of a body of water without damaging it, as can occur when a personal watercraft is simply run onto a beach by an unaided user. The present invention also provides means by which two or more physically capable people can lift a personal watercraft/cradle system combination and carry it to, for instance, the bed of a pick-up truck or to another location for storage. (It is noted that personal watercraft typically do not have convenient elements thereon which allow easy grasping and lifting thereof even when physically capable people are available).

The present invention cradle system is comprised of hollow side pipes oriented in, typically, a generally "V" shaped configuration, which hollow side pipes converge toward a typically rounded interconnection point at the front of the cradle system. The projected angle at which the hollow side pipes converge toward their interconnection point is typically, but not necessarily, fixed and on the order of approximately fifteen degrees. The ends of the hollow side pipes distal to the point of interconnection at the front of the cradle system typically, but not necessarily, present with projections at ninety degrees downward from the plane defined by the upper aspects of the hollow side pipes, (vizualized as the plane formed by placing a flat sheet atop the hollow side pipes), as said hollow side pipes are viewed in side elevation with their lower aspects facing an underlying horizontal surface, from a position perpendicularly removed from the cradle system. It is noted that said distal ends of the hollow side pipes are not closed by the ninety degree projections. The reason for this will be discussed below. (It is also noted that the ninety degree projections can be constructed to add length to the open ends of the hollow side pipes at the back of the cradle system before turning downward). The hollow side pipes are typically, but not necessarily, approximately each seven feet long and the length of the downward projections at the ends thereof can be adjustable. The ends of the hollow side pipes at the back of the cradle system are typically approximately one foot apart as viewed from above when the cradle system is oriented as described above, and the radius of curvature of the typically rounded meeting point of the hollow side pipes at the front of the cradle system is typically twenty-four inches, when similarly viewed. It is noted that the hollow side pipes can be constructed from multiple elements or from a long single hollow pipe which is bent into a "V" shape. That is, the "interconnection" of the hollow side pipes at the front of the cradle system can be effected from one continuous pipe by bending it, and does not necessarily have to be effected by interconnection of two separate hollow side pipe elements. It is to be understood that the Claims to the present invention are to be interpreted to include functionally equivalent single or multiple element construction for all portions of the cradle system.

Rotatably secured between the hollow side pipes are roller systems, which roller systems are typically, but not necessarily, three in number. One roller system is typically located near the front of the present invention, a second typically at approximately the middle of the hollow side pipe lengths, and the third is typically located near the open ends of the hollow side pipes at the back of the cradle system. The construction of each roller system can be visualized as two similar truncated cones attached to one another at the respective equal small diameter truncated ends thereof, with the larger diameter ends thereof respectively each rotatably attached to one, or the other, hollow side pipe. Note that each roller system can be of one-piece or multiple element construction. In addition, projecting up and outward, (termed generally upward), from each hollow side pipe, as the cradle system is viewed from the front or back in elevation when it is situated as described above, are side supports. Each side support is typically dually secured to a hollow side pipe at locations approximately one-third the length of the hollow side pipes from the front and from the back of the cradle system. Elongated side support sections, with side support pads affixed thereto are oriented essentially parallel to the hollow side pipes at a projected distance therefrom, which projected distance is determined by the length of the portions of the side supports which secure the elongated side support section to the hollow side pipes. During use the side support pads affixed to the elongated side support sections contact a locus of points along the lower body of a personal watercraft. The up and outward, (generally upward), angle at which the side supports project from the hollow side pipes, viewed from the front or back of the cradle system as described above, is, in one embodiment of the invention, fixed to provide a nonadjustable angle of one-hundred-twenty-five degrees between the divergent locuses of the side supports, but said angle is adjustable in another embodiment. In addition, in one embodiment of the invention the projected length of the portions of the side supports which are secured to the hollow side pipes and which support the elongated side support sections and associated side support pads in position essentially parallel to a hollow side pipe, can be adjusted. It is noted that most personal watercraft have lower body width dimensions of about two-and-one-half feet and are approximately one foot in height. As mentioned, fixed side support projection lengths and projection angles allow use of the present invention therewith. However, use of the present invention need not be limited to with standard dimension personal watercraft and the capability to adjust the relevant parameters associated with the side supports and hollow side pipes etc. in modified embodiments of the present invention allows the present invention to be used with other than standard dimension personal watercraft. In this light it is specifically mentioned that it is within the scope of the present invention to include means which allow adjustment of the angle at which the hollow side pipes converge, and of the lengths of roller systems secured between said hollow side pipes, if such would be desirable to allow use of the present invention with non-standard sized personal watercraft. In addition, projecting generally upward from the typically rounded interconnection point of the hollow side pipes at the front of the cradle system is a front support, to which front support is affixed a front support pad. Again, the length of, and angle at which the front support projects from the point at which it is secured to hollow side pipes interconnection point can be fixed or adjustable. In practice a personal watercraft is "cradled" in the cradle system by the roller systems at the bottom thereof, and between the side and front support pads along a locus of contact points on the lower body of the personal watercraft. Note that a personal watercraft is not typically supported by present invention support element contact with grooves in the hull thereof as is the case with other systems discussed in the Background Section of this Disclosure. As a result, the present invention can be used with personal watercraft which do not have hulls with grooves therein.

When it is desired to beach a personal watercraft, the open ends of the hollow side pipes are placed into a body of water in which the personal watercraft is present. The cradle system is typically situated such that the hollow side pipe interconnection point at the front of the cradle system rests near the edge of the water. Water naturally enters the hollow side pipes, typically through the open ended downward oriented projections on the ends thereof, when present, which open ended downward projections, when present, rest on the bottom of the body of water. Even though the cradle system is typically constructed from relatively light materials, (e.g. aluminum, PVC etc.), thereby enabling even a young or physically small stature user to easily, without help, carry and position it, when water enters the hollow side pipes the cradle system becomes effectively heavier. Said added effective weight, which results from the presence of water inside the hollow side pipes, serves to stabilize the cradle system in a position selected by a user thereof. A personal watercraft can then be easily run onto the present invention cradle system while it is so stabilized. It is noted that a typical cradle system without water inside the hollow side pipes weighs on the order of fourty pounds. Once a personal watercraft is positioned on a present invention cradle system, a rope can be used to secure the combination to a stable element outside the water.

It is emphasised that the portions of the ends of the hollow side pipes which project downward, when present, can be of a construction which allows their length to be adjusted, thereby facilitating use on beaches with various slopes at the water edge point.

When two or more physically capable people are available and it is desired to move a personal watercraft which is cradled in the cradle system, one person can grasp the hollow side pipe, side support or side support pad on one side of the cradle system, and another the hollow side pipe, side support or side support pad on the opposite side thereof. It is relatively easier for said physically capable people to then lift the cradle system/personal watercraft combination. If water is present inside the hollow side pipes it naturally flows out thereof. As a result, the effective weight attributable to water inside the hollow side pipes which serves to stabilize the position of the cradle system when a personal watercraft is run onto the cradle system is eliminated, leaving only the weight of the cradle system/personal watercraft combination to be lifted.

The present invention then is found in the construction of the cradle system, and the method of use thereof, including the allowing of water to enter the hollow side pipes to stabilize the cradle system at the edge of a body of water, while a personal watercraft is run on thereto.

It is also mentioned that while the cradle system of the present invention does not contain wheels, it is not beyond the method of use of the cradle system to set it upon a wheeled means for easy transport over, for instance, a paved access to a body of water.

The present invention will be better understood by reference to the Detailed Description Section of this Disclosure, in conjunction with the Drawings.

SUMMARY OF THE INVENTION

The use of personal watercraft, such as Jet-Skis, has become widespread in recent years. While in water, personal watercraft are typically boyant and relatively easy to maneuver, even by young or small physical stature users. However, launching, beaching, transporting and storing procedures which involve maneuvering a personal watercraft which is not in water can present a problem. A particularly critical example of this problem manifests when an individual user wishes to secure a personal watercraft after using it, and no one is present to help. In such a situation it is common for such a user to simply run the personal watercraft onto a beach at the edge of a body of water. This can cause damage to the personal watercraft by way of abrasion or, for instance, more dramatically, when a rock is present on the beach and is run over.

A search of Patents shows that inventors have appreciated the identified problems and have provided specific systems which in use serve to help overcome some aspects of launching, transporting and/or storing personal watercraft. However, there remains a need for additional systems and methods of their use which aid users of personal watercraft, particularly in the process of unaided beaching of a personal watercraft without causing damage thereto.

The present invention provides a lightweight cradle system of relatively simple construction which is suitable for use by young or small physical stature individuals, and which allows safe unaided beaching of personal watercraft, in addition to facilitating launching, transporting and storing thereof.

The present invention cradle system is comprised of hollow side pipes which are oriented in a convergent arrangement, between which are systems of rollers, and to which hollow side pipes are secured various projected supports with support pads affixed thereto. In use a personal watercraft is cradled in the cradle system with the roller systems providing support from beneath, and with the supported pads providing support at locuses of points on the lower body of the personal watercraft.

The method of use of the present invention includes allowing water to flow into the hollow side pipes to provide stabilizing effective weight to the cradle system during a personal watercraft beaching procedure. When help iss available, the present invention cradle system provides means by which a cradle system/personal watercraft combination can be easily lifted and transported.

It is also noted that the cradle system with water present in the hollow side pipes stays in place, without the need for securing ropes etc., at the edge of a body of water even when a personal watercraft is not cradled therein. That is, the effective weight of the water in the hollow side pipes is alone sufficient to stabilize the position of the cradle system even without the presence of the additional weight of a personal watercraft.

It is therefore a purpose of the present invention to provide a lightweight cradle system for use in launching, beaching, transporting and storing personal watercraft which is of relatively simple construction.

It is another purpose of the present invention to provide a cradle system which a young or small physical stature person can use, unaided, to beach a personal watercraft without causing damage thereto.

It is yet another purpose of the present invention to provide a cradle system which facilitates the launching, transport and storage of personal watercraft.

It is still yet another purpose of the present invention to provide a method of use of the cradle system of a design which allows an effective stabilizing increase in weight when the cradle system is placed in water to receive a personal watercraft.

DETAILED DESCRIPTION

Figure 1:
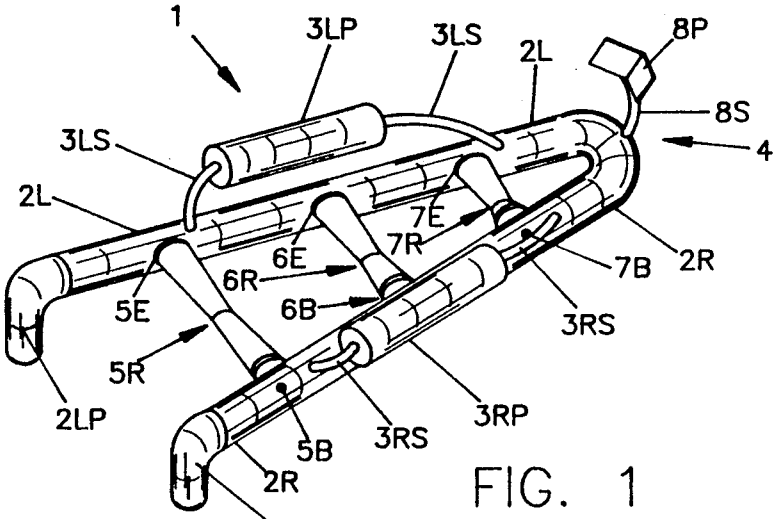
FIG. 1 shows the cradle system of the present invention in perspective as viewed from the back, top and right.
Figure 6:
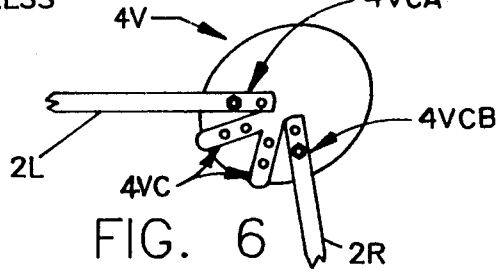
FIG. 6 shows a top view of an exemplarly means for allowing adjustment of the angle at which hollow side pipes converge in the cradle system of the present invention.

Turning now to the drawings, there is shown in FIG. 1 a perspective view of the cradle system (1) of the present invention. In particular there are shown left and right converging hollow side pipes, (2L) and (2R) respectively, which attach to one another in a typically, but not necessarily, rounded fashion at the front (4) of the cradle system (1) to form a generally "V" shaped hollow side pipe configuration. It is to be noted that said shape can be provided by one hollow pipe being bent, or by two hollow pipes being interconnected to one another, at cradle system front (4) location. The angle of convergence between the hollow side pipes (2L) and (2R) can be fixed at approximately fifteen degrees, or adjustable, and the lengths of the hollow side pipes (2L) and (2R) are typically, but not necessarily fixed at seven feet each. FIG. 6 shows an exemplary interconnection means (4V) for use with two hollow side pipes (2L) and (2R) should it be desired to be able to adjust the angle at which the hollow side pipes (2L) and (2R) converge to their meeting point, to allow use with various width personal water craft. Note that in FIG. 6 a flat circular element (4V) is shown with a multiplicity of radial channels (4VC) present. Hollow side pipes (2L) and (2R) can be placed into selected (eg. (4VCA) and (4VCB)) radial channels and secured to the circular element (4V), typically by bolts or functional equivalent, (eg. glue or pins), to provide a desired secured angle between the hollow side pipes (2L) and (2R). Any functionally equivalent connection means to that of circular element (4V) is to be considered within the scope of the Claims. Continuing, FIG. 1 also shows typically present, but optional, downward projections (2LP) and (2RP) at the open ends of each hollow side pipe (2L) and (2RP); a multiplicity of roller systems (5R), (6R) and (7R) rotatably connected between the hollow side pipes (2L) and (2R); side supports (3LS) and (3RS) which support side support pads (3LP) and (3RP) respectively at some distance from the related hollow side pipe (2L) and (2R) respectively, and a front support (8S) which supports a front support pad (8P) at some distance from the front (4) portion of the cradle system (1).

Figure 4:
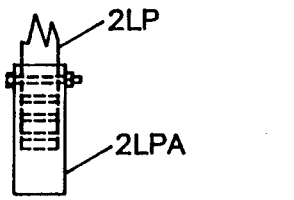
FIG. 4 shows a cross sectional view of an exemplarly means for allowing adjustment of the length of a projecting element.

Downward projections (2LP) and (2RP) can be present at the open ends of hollow side pipes (2L) and (2R) and of fixed or adjustable length at both horizontal and downward projection ends thereof. FIG. 4 shows an exemplary means for use when said downward projections (2LP) and (2RP) are to be of adjustable length. Note that downward projection from hollow side pipe (2L) is shown as (2LP). An extension downward projecting element (2LPA) is shown sliding over downward projecting element (2LP) and secured thereto by a bolt which extends through the combination of elements by way of holes therethrough. Again, any functionally equivalent means to that shown in FIG. 4 allowing length adjusting capability is to be considered within the scope of the Claims.

As regards the roller systems, there are typically three thereof present as shown in FIG. 1 and referenced above, but the invention can be practiced with fewer or more than three roller systems and the number of roller systems is not limiting to the operation of the invention. When three roller systems are present they are rotatably attached between the hollow side pipes (2L) and (2R), one near the open ends of the length of the hollow side pipes (2L) and (2R), one near the middle thereof and one near the front (4) of the cradle system (1) respectively, as shown in FIG. 1. Also shown are roller system elements (5E), (6E) and (7E) which can be added or deleted to or from roller systems (5R), (6R) and (7R) respectively to provide lengths thereof sufficient to fill the space between rotatable attachment points the hollow side pipes (2L) and (2R). This might be necessary, for instance, when the angle at which the side pipes (2L) and (2R) converge is changed by use of a hollow side pipe interconnection means such as the exemplary interconnection means (4V) shown in FIG. 6. Note also, that the roller systems (5R), (6R) and (7R) are typically each constructed to appear as two truncated cones with their respective small diameter ends attached to one another. The larger and smaller diameters of each truncated cone of roller systems (5R), (6R) and (7R) are typically three-and-one-half and two-and-one-quarter inches respectively. This allows good contact with the bottom of a typical personal watercraft, the shape of which is generally demonstrated in FIG. 3. The rollers of the roller systems are typically, but not necessarily, made from molded rubber, soft plastic or a suitable functional equivalent and the rollers can be of one piece or multiple element construction. Support for the roller systems (5R), (6R) and (7R) can be provided by a axle rods, (indicated by dots (5B), and (7B) and identified (6B) on hollow side pipe (2R) in FIG. 1), which project through longitudinal central axises of the roller systems (5R), (6R) and (7R) and attach to the hollow side pipes (2L) and (2R). Said axle rods can also provide general structural stability to the cradle system (1).

Figure 5:
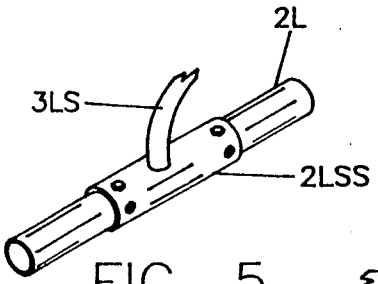
FIG. 5 shows a perspective view of an exemplarly means for allowing adjustment of the angle at which a projecting element projects.

The side and front supports (3LS), (3RS) and (8S) can be of fixed or adjustable lengths and project from their connection points with the hollow side pipes (2L) and (2R) or the front (4) portion of cradle system (1), at fixed or adjustable, generally upward, (i.e. upward and outward), angles. If the angles are fixed, there will typically be approximately one-hundred-twenty (120) degrees between the projected locus meeting point of side supports (3LS) and (3RS) below roller system (7R), as can be visualized by reference to FIG. 3 by extending the locus of the side supports (3LS) and (3RS) downward. Fixed lengths of the side supports (3LS) and (3RS) are typically approximately three-and-one-half feet each. Lengths of the various supports, (e.g. side supports (3LS), (3RS) and front support (8S)), can be made adjustable by a means such as demonstrated in FIG. 4, and described with respect to application to the downward projections (3LS) and (3RS) above, or functional equivalent. (Note that elements (2LPA) can be connected to hollow side pipes (2L) and (2R) at the locations thereon at which the side and front supports (3LS), (3RS) and (8S) are shown as being directly attached in FIG. 1. Elements (2LP) can be made continuous with the ends of the side and front supports (3LS), (3RS) and (8S), which elements (2LP) will adjustably insert into said elements (2LPA)). The generally upward oriented angle of projection from their connection points with hollow side pipes can be adjustable by means such as exemplified in FIG. 5. Shown in FIG. 5 is hollow side pipe (2L) over which is a sleeve (2LSS). Various of the holes shown in sleeve (2LSS) can be lined up with holes through hollow side pipe (2L) and bolts or pins etc. can be used to secure the side support (3LS) at a desired projection angle. Any functionally equivalent means for providing projection angle adjustability is to be considered within the scope of the Claims. Side support pads (3LP) and (3RP) are present along elongated portions of the side supports (3LS) and (3RS) which are essentially parallel to the associated hollow side pipe (2L) or (2R), respectively. It is to be noted that said side support pads (3LP) and (3RP), (and front support pad (8P)), can be of various outer diameters, thicknesses and/or lengths to facilitate effective cradling of the sides of the lower body of a personal watercraft and are typically made from foam rubber. It is noted for completeness that hollow side pipes (2L) and (2R) and downward projections (2LP) and (2RP) are typically, but not necessarily, circular in cross section and of outer and inner diameters of four (4) and three-and-one-half inches respectively. Side and front supports (3LS), (3RS) and (8S) are also typically, but not necessarily, circular in cross section and of outer and inner diameters of two-and-one-half and two-and-one-quarter inches respectively.

Figure 2:
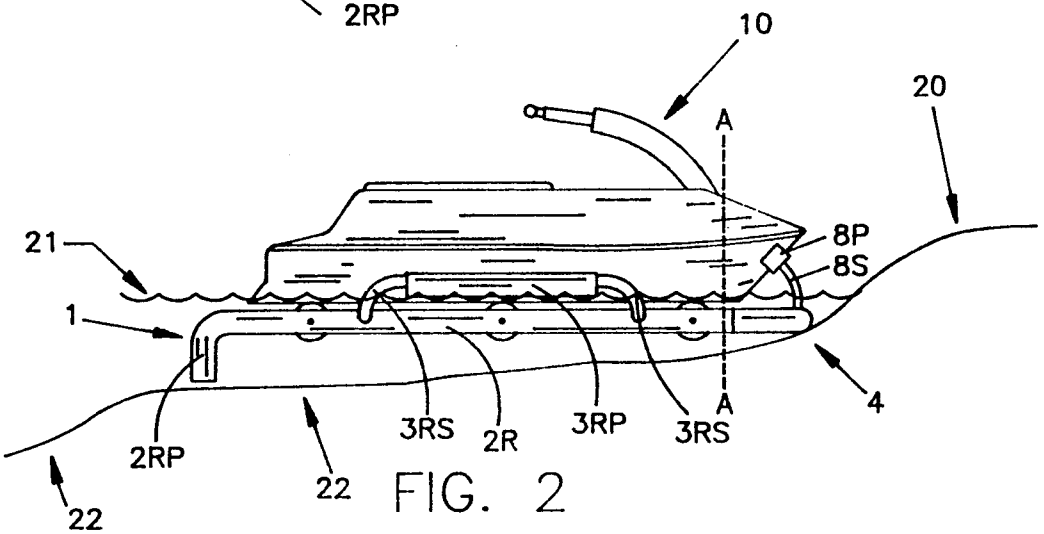
FIG. 2 shows a right side elevational view of the cradle system of the present invention with a personal watercraft cradled therein.

FIG. 2 shows a side elevational view of the cradle system (1) of the present invention with a personal watercraft (10) cradled therein. An indication of a beach (20), water surface (21) and bottom of a body of water (22) near the edge thereof is also shown to demonstrate how the cradle system (1) of the present invention is positioned to cradle a personal watercraft (10) at the edge of a body of water. Depending on the angle of land drop-off at the beach/water edge the front (4) of the cradle system (1) might be above water rather than below as shown in FIG. 2, and the lengths of downward projections (2LP) and (2RP), if present, might have to be adjusted. A rope or equivalent, (not shown), from the beach (20) can be attached to the cradle system/personal watercraft combination to secure said positioning. However, this is typically not necessary as the effective weight of the water in the hollow side pipes is sufficient to stabilize the position of a cradle system (1). A rope, or ropes, (or equivalents), also can secure the cradle system/personal watercraft combination as a unit during transporting or storing thereof. Hooks and/or eyes can be attached to the cradle system (1) at appropriate locations to facilitate said securing.

Figure 3:
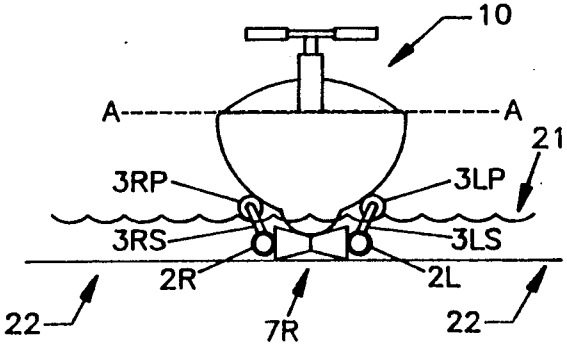
FIG. 3 shows a front elevational cross sectional view of the cradle system of the present invention taken at "a—a" in FIG. 2.

FIG. 3 shows a front elevational cross section view of the system (1) and personal watercraft (10) taken at "a—a" in FIG. 2. Note that the lower aspect of the personal watercraft (10) is seen to rest on shown roller system (7R), and that the lower body of the personal watercraft (10) is supported by side support pads (3RP) and (3LP).

It is to be understood that the cradle system (1) is typically constructed from light weight materials such as aluminum or PVC etc. As a result the cradle system (1) is relatively lightweight (e.g. typically approximately fourty pounds), and can be easily carried and positioned by a young or small physical stature person. This makes it possible for such a young or small physical stature person to position the cradle system (1) at the edge of a body of water in which is present a personal watercraft, with the open downward projections (2LP) and (2RP) in the water and with the front (4) of the cradle system (1) present near the edge of the water. When so positioned the open ends of hollow side pipes (2L) and (2R) or of downward projections (2LP) and (2RP), when present, allow water to enter the hollow side pipes (2L) and (2R) and provide stabilizing effective weight to the cradle system (1). When the cradle system (1) is so positioned and stabilized a personal watercraft can be run on thereto and secured at the edge or beach of the body of water in a position as demonstrated in FIG. 2. The personal watercraft is then what can be termed "beached". Such a beached personal watercraft is very unlikely to be damaged as the roller systems (5R), (6R) and (7R), as well as the side and front support pads (3LP), (3RP) and (8P) provide nonabrasive cushions which gently cradle the personal watercraft (10). Without the present invention cradle system (1) an unaided user of personal watercraft must typically run a personal watercraft onto a beach at the edge of a body of water to secure it. Personal watercraft can be damaged by abrasion or collision with rocks etc. present.

When two or more physically capable people are available and wish to transport the cradle system/personal watercraft combination the task is facilitated by the presence of the hollow side pipes (2L) and (2R), side supports (3LS) and (3RS) and side support pads (3LP) and (3RP) on the cradle system (1). Personal watercraft (10) typically do not provide convenient means for gripping thereof and it is therefore difficult to maneuver personal watercraft (10) which are out of water. A typical transport procedure involves one person grasping hollow side pipe (2L), side support (3LS) and/or side support pad (3LP) and another grasping hollow side pipe (2R), side support (3RS) and/or side support pad (3RP), and simple lifting the cradle system/personal watercraft combination, then carrying same to the bed of a pickup truck or other location.

It is noted that the hollow side pipes (2L) and (2R) can have small holes present at various locations along the lengths thereof, to facilitate water entry and exit at other than the open ends thereof during use. Also, side support pads (3LP) and (3RP) can be extended to entirely cover side supports (3LS) and (3RS).

The present invention is thus disclosed as present in the design and construction of the cradle system (1), and in the method of use thereof to aid launching, beaching, transporting and storing of a personal watercraft (10), including allowing water to provide effective stabilizing weight to the cradle system (1) by entering hollow side pipes (2L) and (2R) when the cradle system (1) is used in a personal watercraft (10) beaching procedure.

Having hereby disclosed the subject matter of the present invention, it should be obvious that many modifications, substitutions and variations of the present invention are possible in light of the teachings. It is therefore to be understood that the invention can be practiced other than as specifically described and should be limited in breadth and scope only by the Claims.

I claim:

1. A cradle system for cradling personal watercraft comprising hollow side pipes which converge to an interconnection point at a front aspect of said cradle system so as to form a "V" shape as said cradle system is viewed from a position perpendicularly thereabove while said cradle system rests on an essentially horizontal underlying surface, said hollow side pipes being open at their non-interconnected ends distal to said interconnection point; between which hollow side pipes are rotatably attached roller systems, said roller systems essentially filling the distance between said hollow side pipes at their points of attachment thereto; from which hollow side pipes project, generally upward, side and front supports with side and front support pads present thereon; such that during use a personal watercraft is functionally cradled in the cradle system with support at the bottom thereof being provided entirely by said roller systems and with support thereof at the lower body of the personal watercraft being provided by said side and front support pads, with no support being provided to said personal watercraft by direct contact with said hollow side pipes, which cradle system further comprises downward projections at the non-interconnected open ends of the hollow side pipes, said downward projections providing continuous access to inner space within said hollow side pipes.

2. A cradle system as in claim 1 in which the lengths of said side and front supports, and the angles which said side and front supports make at their attachments to said hollow side pipes, are adjustable.

3. A cradle system as in claim 1 in which the angle at which the hollow side pipes converge to form the "V" shape is adjustable.

4. A cradle system as in claim 1 in which the downward projections are adjustable in length.

5. A cradle system as in claim 1 in which the hollow side pipes interconnection at the front of the cradle system is rounded in shape with a radius of curvature of twenty-four inches.

6. A cradle system as in claim 1 in which the roller systems are each of one piece construction and appear as two truncated cone shaped elements attached to one another at the small diameter ends thereof, with each large diameter end thereof being respectively rotatably attached to one of said hollow side pipes.

7. A cradle system as in claim 6 in which at least one of said roller systems comprises multiple elements.

8. A cradle system as in claim 1 in which there are three roller systems.

9. A cradle system as in claim 1 in which each side support is attached to a hollow side pipe at two locations, each side support having an elongated portion thereof extending between said locations of attachment, at a projected distance from, and essentially parallel to, said hollow side pipe.

10. A cradle system as in claim 1 in which the side and front support pads are made from foam rubber.

11. A cradle system as in claim 1 in which the rollers of the roller systems are made from rubber.

12. A cradle system as in claim 1 in which the hollow said pipe have outer and inner diameters of three-and-one half and three inches respectively, and are each seven feet long with a separation of one foot at their open non-interconnected ends.

13. A method of beaching a personal watercraft comprising the steps of:

a. obtaining a cradle system for cradling personal watercraft comprising hollow side pipes which converge to an interconnection point at a front aspect of said cradle system so as to form a "V" shape as said cradle system is viewed from a position perpendicularly thereabove while said cradle system rests on an essentially horizontal underlying surface, said hollow side pipes being open at their non-interconnected ends distal to said interconnection point; between which hollow side pipes are rotatably attached roller systems, said roller systems essentially filling the distance between said hollow side pipes at their points of attachment thereto; from which hollow side pipes project, generally upward, side and front supports with side and front support pads present thereon; such that during use a personal watercraft is functionally cradled in the cradle system with support at the bottom thereof being provided entirely by said roller systems and with support thereof at the lower body of the personal watercraft being provided by said side and front support pads, with no support being provided to said personal watercraft by direct contact with said hollow side pipes;

b. placing the open ends of the hollow side pipes distal to their interconnection point at the front aspect of the cradle system into a body of water which contains a personal watercraft and letting water run into the hollow side pipes so that the cradle system is stabilized, with or without additional stablizing means, in said position by the effective weight added to the cradle system by said water;

c. running the personal watercraft into the cradle system.

14. A method of beaching a personal watercraft as in claim 13 which further comprises the transport of said personal watercraft by simultaneously grasping oppositely positioned hollow side pipes, side supports and/or side support pads, lifting the cradle system/personal watercraft combination so that the water in the hollow side pipes runs out, and carrying the cradle system/personal watercraft combination to the bed of a pickup truck or other location.

15. A method of beaching a personal watercraft as in claim 14 which further comprises the launching of said personal watercraft by simultaneously grasping oppositely positioned hollow side pipes, side supports and/or side support pads, lifting the cradle system/personal watercraft combination which is located in the bed of a pickup truck or elsewhere, carrying the cradle system/personal watercraft combination to the edge of a body of water and placing the cradle system/personal watercraft combination into said body of water in a manner which allows the personal watercraft to float free of the cradle system.

16. A method of beaching a personal watercraft as in claim 13 which further comprises the step of allowing the cradle system/personal watercraft combination to remain in the position assumed when the personal watercraft is run into the cradle system.

17. A method of beaching a personal watercraft as in claim 13 which further comprises the step of securing the cradle system to the beach by one or more ropes or functional equivalent.

18. A method of beaching a personal watercraft as in claim 13 in which the front of the cradle system is placed near the edge of the body of water.

* * * * *